United States Patent [19]

Bunts

[11] Patent Number: 4,919,107

[45] Date of Patent: Apr. 24, 1990

[54] EQUALIZED FORCE SHOOTER FOR A BOW AND ARROW

[75] Inventor: Walter A. Bunts, Crystal River, Fla.

[73] Assignee: Walter A. Bunts, Crystal River, Fla.

[21] Appl. No.: 211,975

[22] Filed: Jun. 27, 1988

[51] Int. Cl.[5] ..... F41B 5/00

[52] U.S. Cl. ..... 124/24 R; 124/86; 124/88

[58] Field of Search ..... 124/86, 88, 90, 91, 124/92, 31, 35 R, 35 A, 25, 24 R, 23 R

[56] References Cited

U.S. PATENT DOCUMENTS

| | | | |
|---|---|---|---|
| 2,926,650 | 3/1960 | Irwin . | |
| 3,010,446 | 11/1961 | Frantello | 124/86 |
| 3,512,512 | 5/1970 | Wentz . | |
| 3,557,769 | 1/1971 | Hofmeister | 124/88 |
| 3,561,418 | 2/1971 | Friedrickson . | |
| 3,599,621 | 8/1971 | Scrobell | 124/90 |
| 3,750,641 | 8/1973 | Ramsey | 124/91 |
| 4,086,904 | 5/1978 | Suski et al. | 124/90 |
| 4,290,407 | 9/1981 | Damron | 124/88 |
| 4,615,326 | 10/1986 | Rathbun | 124/88 |
| 4,732,133 | 3/1988 | Chattin | 124/90 |

*Primary Examiner*—Randolph A. Reese
*Assistant Examiner*—John Ricci

[57] ABSTRACT

A device attached to a compound bow which is fully adjustable to permit the shooter to adjust and lock into place a sliding trigger holder which locks into the same position at each arrow draw precisely in the same release spot so all arrows fly straight and true. This device, once adjusted and locked into place makes it possible for any archer using this bow to be extremely accurate with all arrows shot. The device maintains its accuracy indefinitely. The device also includes a palm support at full draw to eliminate the bow pull tension from affecting the arrow release.

3 Claims, 1 Drawing Sheet

EQUALIZED FORCE SHOOTER FOR A BOW AND ARROW

FIELD OF INVENTION

This invention relates to the sport of archery, specifically to an improved mechanism which provides repeatable accuracy for any archer.

DESCRIPTION OF PRIOR ART

Heretofore bow string holding mechanisms had no way to align the forces of the drawn bow string and insure that the release point was always in the exact same spot absolutely necessary for extremely accurate shooting.

It is assumed that anyone skilled in the archery will be completely aware of the necessity of "Tuning" any bow. The method is generally described as a means of determining perfect arrow flight by repeatedly shooting unfletched arrows and noting the arrow fight and target condition of the arrow. Tuning requires that a final nocking point is established on the bow string which will send all arrows on straight non-wavering flight. A complete description of the bow tuning procedure accompanies this application.

Prior U.S. Pat. No. 2,926,650 by H. G. Irwin and U.S. Pat. No. 3,561,418 by B. E. Fredrichson make no mention of forces alignment and are not capable of such adjustments. None of the prior patents are capable of the adjustments absolutely necessary to "TNE" the bow and maintain the exact release point through repetitive shooting. There is only one exact spot for the arrow release point and this must be found and locked in for extreme accuracy. No prior patents embody such means of adjusting and locking in this release point. Both patents listed above show the rear extension shaft in a rigid fixed position with no adjustability. Both are locking devices to lock the bow string mechanically in a ready to shoot position. They are actually crossbows.

U.S. Pat. No. 3,512,512 by P. L. Wentz likewise does not improve accuracy. Finger release permits arrow flight in differing manners since the string may flow off the fingers in different manners and rates. This device does not improve accuracy.

DESCRIPTION OF DRAWING

The FIGURE shows a compound bow with arrow in the tuned drawn condition. The FIGURE shows the arrow is drawn to the anchor point. It shows that the slide rod is located and locked to the bow's tuned anchor point, thus allowing the slide to be in correct position with the string and arrow in tune with the bow.

DESCRIPTION OF INVENTION

Figure 1:
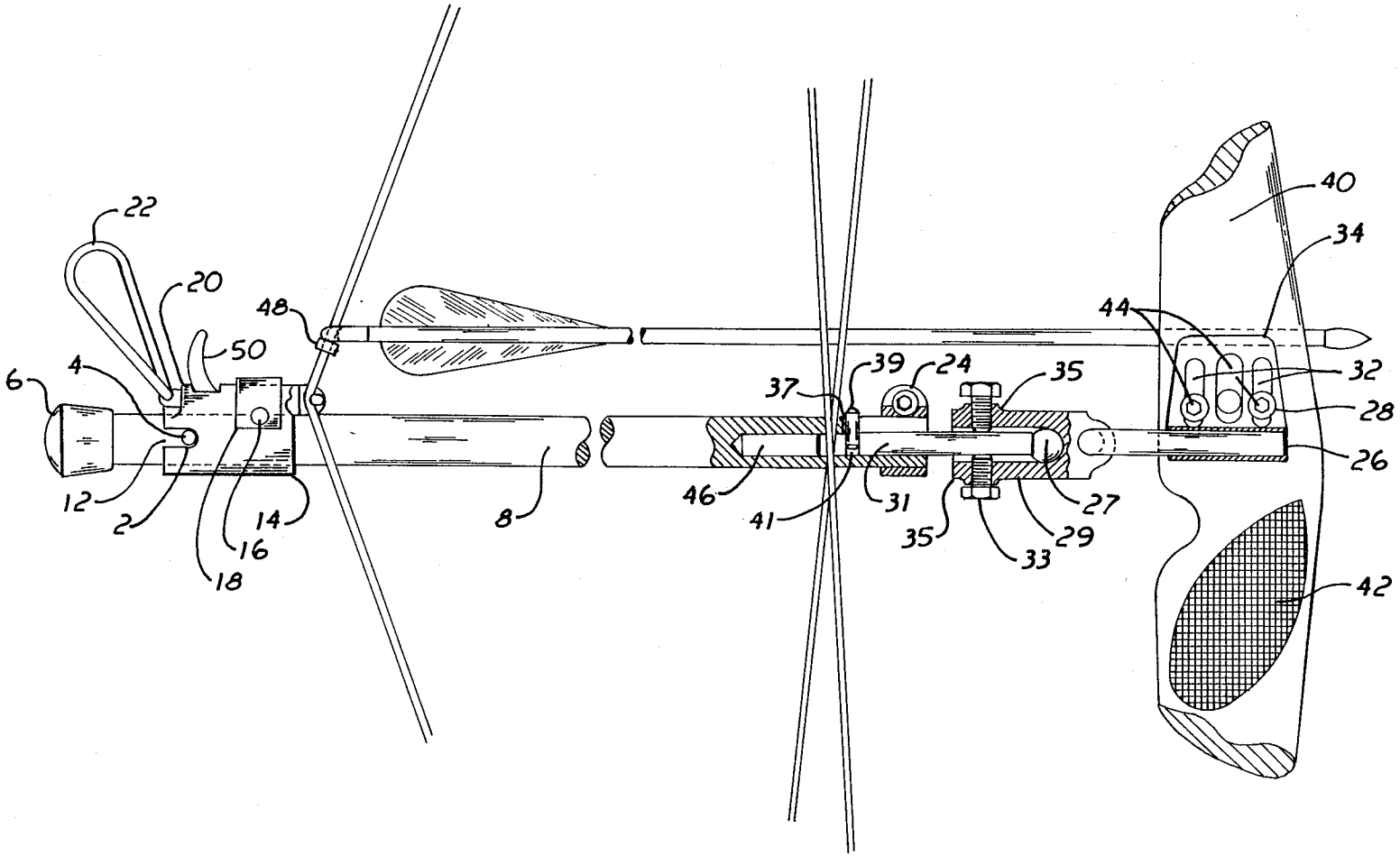

The adjustable locking device of the figure will always release an arrow on the exact same path with constantly repeatable accuracy.

This device is attached to a bow 40 by the attaching screws 28 these attaching screws 28 pass through the slide rod mount attaching plate 34 via the slide holes 32 into the bow 40.

Slide rod 8 has a receiving hole 46 that is drilled about six inches deep into the slide bar 8. This receiving hole 46 is offset and is a snug sliding fit onto the shaft 31. Slide rod 8 may be rotated around shaft 31. This orbital movement permits slide rod 8, with slide 14 attached, to move in a linear direction.

A snug fit ball and socket joint 27 is rigidly attached to the slide rod mount 26. The sleeve 29 surrounds the ball and socket joint 27 and is securely attached to the slide rod mount 26. This ball and socket joint contains a mounting shaft rigidly attached to the ball. Adjusting screws 33 are placed into the tapped holes 35 of the sleeve 29. Four tapped holes 35 are located forward of the ball sufficiently far as to make movement of the mounting shaft as well as locking this shaft 31 permanently in position.

These four screws 33 are placed 90 degrees apart and are actually on both the horizontal and the vertical plane of the bow 40. This entire adjusting and locking means could also be located to the rear of the ball joint.

The slide rod locating slot 37 is about one inch in length and is notched into the slide rod 8 at it's forward end. The slide rod aligning pin 39 is properly located onto the mounting shaft 31 to receive the slide rod locating slot 37.

Slide rod 8 is slipped onto and over the mounting shaft 31 fully engaging the slide rod locating slot 37. A screw clamp 24 is placed around the slide rod 8 about ½ inch from the forward end of the slide rod 8.

When the screw clamp 24 is tightened around the slide rod 8 the slide rod slot 37 is compressed thus locking the slide rod 8 to the mounting shaft 31.

Slide 14 is a hollow cylinder about 3 inches long and is made to slide freely along the slide rod 8. Slide 14 is placed over slide rod 8. Slide 14 has a locating notch 12 and a trigger release mechanism 20 commonly used by archers. This mechanism is also fitted with a wrist strap 22. This trigger release is held onto the trigger release sleeve 18. A set screw 16 locks the trigger release mechanism 20 onto the slide 14.

Guide positioning pin 2 is drive fitted into a hole properly located in slide rod 8.

A rubber butt 6 is placed over the end of the slide rod 8.

OPERATION OF INVENTION

My invention will allow an arrow to be launched, from a tuned bow, by anyone with extreme repeatable accuracy.

To shoot an arrow smoothly and accurately from a compound bow, the bow must be tuned to a high degree of accuracy.

First a compound bow is tuned. Next a slide rod of the proper draw length is selected. This slide rod 8 is then attached to the mounting shaft 31.

My invention is installed in an assembled form (FIG. 1) onto the bow 40 at a point just above the bow grip 42. The device is held onto the bow 40 by passing attaching screws 28 through the slide holes 32. The attaching screws 28 are turned into pre-tapped holes 44 of the tuned bow 40. The attaching screws 28 are tighten sufficiently so that their force holds the device securely onto the tuned bow 40.

The device is installed as close to a perpendicular angle to the tuned bow string 10 as possible.

The slide 14 with the trigger release mechanism 20 attachd is moved down the slide rod 8 until the string grasping mechanism of the trigger release mechanism 20 engages the bow string 10. The position of the bow string is noted. If the trigger release mechanism 20 is not aligned with the bow string 10 a slight adjustment will be necessary to move the grasping mechanism of the trigger release mechanism 20 in alignment with the bow string 10. The slide rod 8 is rotated around the shaft 31 via the slide rod receiving hole 46 that is drilled at an eccentric at the forward end of the slide rod 8. The orbital movement of the eccentric hole called the slide rod receiving hole 46 of the slide rod 8 causes the slide 14 to move in a linear direction. Normally only a small adjustment is necessary to move the grasping mechanism of the trigger release mechanism 20 to an aligned position with the bow string 10.

The location of the slide rod locating slot 37 is noted and a slide rod aligning hole 41 is drilled into the mounting shaft 31; at a location corresponding to the rear end of the slide rod locating slot 37. The slide rod aligning pin 39 is placed firmly in position into the slide rod aligning pin hole 41.

The screw clamp 24 is now tighten rigidly holding the slide rod 8 onto the mounting shaft 31. The aligning of the trigger release mechanism 20, that was accomplished by rotating the slide rod 8 around the mounting shaft 31 and located by use of the slide rod locating slot 37 and slide rod aligning pin 39, is a one time operation and is used in the initial set up of the invention to the bow.

An arrow that has been used in tuning the bow 40 is placed at the nocking point 48. The slide 14 with the trigger release mechanism 20 is moved forward along the slide 14 until the trigger release mechanism 20 makes contact with the bow string 10. The trigger release mechanism 20 grasps the bow string 10. The archer now places his hand through the wrist strap 22. The tuned bow 40 is drawn by pulling the trigger release mechanism 20 to the rear by the use of the archers wrist. The use of the wrist strap 22 which is attached to the trigger release mechanism 20 allows the free use of the fingers of the hand that draws the bow string 10 to the rear. Drawing the bow string 10 brings the slide 14 and the trigger release mechanism 20 to the rear along the slide rod 8. This motion is stopped when the guide pin locator notch 12 makes contact with the guide pin 2. The drawn bow 40 is now fired by using the forefinger to pull the trigger 50 that is part of the trigger release mechanism 20.

The arrow, that has been used in tuning the bow 40, is launched into the target. A noticeable tail-high or tail-low and an apparent yaw will occur. The tuned anchor point of the bow 40 must now be located again. This tuned anchor point will now be found somewhere to the rear of the tuned bow 40, along the slide rod 8. An arrow is placed on the rest. Now the arrow is nocked onto the bow string 10 at the nocking point 48.

The adjusting screws 33 that are rigidly supporting the mounting shaft 31 will now be slightly loosened to allow adjustment of the mounting shaft 31. Loosening the upper adjusting screw 33 one turn and correspondingly tightening the lower adjusting screw 33 will cause the mounting shaft 31 to move in an upward direction, changing the position of the mounting shaft 31 and the vertical angle of the mounting shaft 31, that extends from the slide rod mount 26. The adjusting screws 33 are now tightened, locking the mounting shaft 31 into its new position, the mounting shaft 31 is rigidly held by the adjusting screws 33 and by the ball and socket joint 27. Moving the mounting shaft 31 in a horizontal direction is easily accomplished. Loosening the right adjusting screw 33 one turn and correspondingly tightening the left adjusting screw 33 one turn will cause the mounting shaft 31 to move to the right. The horizontal angle of the mounting shaft 31 that extends from the slide rod mount 26 will also change.

Let us assume that an arrow was shot, and this arrow hits the target tail-high. Loosen the upper adjusting screw 33 approximately one turn and tighten the lower adjusting screw 33 approximately one turn, making sure that the lower adjusting screw 33 makes firm contact with the mounting shaft 31. In performing this operation the anchor point of the drawn bow string 10 will move upward with the vertical movement of the mounting shaft 31. Next shoot another arrow and not the vertical tail position. The previously tail-high arrow will now be seen to straighten out as it hits the target. If the vertical position of the arrow is still slightly tail-high, the upper adjusting screw 33 must be loosened again. This movement of the adjusting screw 33 should be less then the first, so try about ¼ turn. Tighten the lower adjusting screw 33 approximately ¼ turn, making firm contact with the mounting shaft 31. Shoot another arrow into the target. Note the vertical position of the tail again. The vertical plane of the arrow should now be perpendicular to the plane of the target. It may require one or two more slight adjustments of the adjusting screw 33 to find this position of the tuned anchor point, but this is done quickly, and easily. Of course if the initial shot of the arrow was tail-low the lower adjusting screw 33 tightened, with the adjusting the upper adjusting screw 33 tightened, with the adjusting procedure done in the reverse. Once the vertical position of the tuned anchor point has been located the horizontal position must now be found.

Shoot another arrow and note the horizontal position of the arrow shaft; tail-left or tail-right. Let us assume that the shaft is tail-right in the target. To straighten out the tail-right, the anchor point must be moved to the right. To move the anchor point to the right loosen the right adjusting screw 33 and tighten the left adjusting screw 33. If more adjustments are needed, loosen the right adjusting screw 33 about ¼ turn, then tighten the left adjusting screw 33 ¼ turn. Be sure to make firm contact with the mounting shaft 31. Shoot another arrow, this should produce a straight shooting arrow. If more adjustments are needed to find the horizontal position of the tuned anchor point they will be small adjustments of the right and left adjusting screw 33. If the initial shot of the arrow was tail-left, the left adjusting screw 33 would have been loosened and the right adjusting screw 33 would have tightened to move the shaft to the left, thus finding the tuned anchor point.

Every time the bow 40 is drawn, the slide 14 will engage the guide pin locator 12 to the guide pin 2, thus allowing the archer to draw the bow 40 to its tuned anchor point with each slot.

Now, shot after shot will fly from the bow 40 with extreme and repeatable accuracy when the archer draws the bow to its tuned anchor point.

CONCLUSION

The reader can now clearly see that my invention provides a new and better use of the compound bow.

Once my invention is attached and tuned at the proper anchor point, the archer will have extreme accuracy with each shot. Shot after shot will fly from the bow without yaw or porpoising. Each arrow that leaves the bow will fly straight.

A person can shoot an arrow from a compound bow with my invention and the arrow will fly in a tuned condition shot after shot. This same person can allow another person to shoot an arrow through the same compound bow, with my invention attached, and the arrow will fly in a tuned condition.

This has never before been possible, because each person that shoots the bow will have a different draw length and anchor point. However, with my invention, the draw length and tuned anchor point are built into the mechanism. Therefore, any person who draws the bow and brings the slide guide pin locator into contact with the guide pin, has achieved the tuned anchor point.

The description of my invention contains many specificities. These should not be construed as limitions on the scope of my invention, but rather an exemplification of one preferred embodiment thereof.

For example, a different size or shape of guide pin or guide pin hole may be used. Another location of the guide pin locator could be used. Another type of trigger release mechanism may be installed. Almost any reasonable size or shape of the slide rod mount could be built. The off-set hole of the slide rod receptable may be of various positions and the slide hole has no set size, shape or location. The ball and socket joint could be made out of various materials, and be of various sizes. The mounting shaft has no set size and could be manufactured out of various materials. The invention could be almost any color or various mixtures of colors.

I claim:

1. An apparatus for mechanically locating and maintaining the precise location of the tuned condition of an archers bow and arrow, comprising:

a slide rod mount having a forward and rearward end;

attachment means for rigidly fastening said forward end of said slide rod mount positioned approximately at the middle portion of the bow;

a sleeve having a forward and rearward end and a bore.

means to rigidly connect said forward end of said sleeve to said rearward end of said slide rod mount;

a ball and socket joint;

means to securely attach said ball and socket joint to said forward end of said sleeve within the bore of said sleeve;

a mounting shaft having a forward and rearward end;

a forward portion of said mounting shaft having a smaller diameter than the bore of said sleeve is located within said sleeve;

means to rigidly connect said forward end of said mounting shaft to the ball of said ball and socket joint;

said mounting shaft extends rearward out of said sleeve, and approximately perpendicular to the longitudinal axis of the bow;

a plurality of adjusting screws pass through a rearward portion of said sleeve allowing said mounting shaft to be located and to rigidly hold said mounting shaft at the proper tuned location;

a slide rod having a forward and rearward end;

said forward end of said slide rod rigidly attached to said rearward end of said mounting shaft;

a slide having a forward and rearward end;

said slide slidably surrounds said slide rod;

said slide having a guide pin locator notch at said rearward end of said slide;

means attached to said slide to rigidly hold an archers trigger release mechanism onto said slide to allow the bow string and said slide to be drawn rearward from a middle portion of the bow and parallel to the axis of said slide rod;

a guide pin located at a rearward portion of said slide rod to locate said guide pin notch to said guide pin, allowing said slide and a bow string to be drawn to its correct tuned position.

2. An apparatus for mechanically locating and maintaining the precise location of the tuned condition of an archers bow and arrow, comprising:

a slide rod mount having a forward and rearward end;

attachment means for rigidly fastening said forward end of said slide rod mount positioned approximately at the middle portion of the bow;

a mounting shaft having a forward and rearward end;

said forward end of said mounting shaft is rigidly connected to said rearward end of said slide rod mount;

said mounting shaft extends rearward and substantially perpendicular to the longitudinal axis of the bow;

a slide rod having a forward and rearward end;

a slide rod receiving hole of slightly larger diameter than said mounting shaft is located at said forward end of said slide rod;

said slide rod receiving hole being bored into a forward portion of said slide rod, parallel to the longitudinal axis of said slide rod, furthermore said slide rod receiving hole is formed offset from center into a forward portion of said slide rod allowing a frictional fit between a rearward portion of said mounting shaft and the bore of said slide rod receiving hole enabling the longitudinal axis of said slide rod to orbit in a parallel fashion around the longitudinal axis of said mounting shaft;

means to rigidly hold said slide rod in its tuned orbital position onto said mounting shaft;

a slide having a forward and rearward end;

said slide slidably surrounding said slide rod;

said slide having a guide pin locator notch at said rearward end of said slide;

means attached to said slide to rigidly hold an archers trigger release mechanism onto said slide to allow the bow string and said slide to be drawn rearward from a middle portion of the bow and parallel to the axis of said slide rod;

a guide pin located at a rearward portion of said slide rod to locate said guide pin notch to said guide pin, allowing said slide and a drawn bow string to be drawn to its correct tuned position.

3. An apparatus for mechanically locating and maintaining the precise location of the tuned condition of an archers bow and arrow, comprising:

a slide rod mount having a forward and rearward end;

attachment means for rigidly fastening said forward end of said slide rod mount positioned approximately at the middle portion of the bow;

a sleeve having a forward and rearward end and a bore;

means to rigidly connect said forward end of said sleeve to said rewarward end of said slide rod mount;

a ball and socket joint;

means to securely attach said ball and socket joint to said forward end of said sleeve within the bore of said sleeve;

a mounting shaft having a forward and rearward end;

a forward portion of said mounting shaft having a smaller diameter than the bore of said sleeve that is located within said sleeve;

means to rigidly connect said forward end of said mounting shaft to the ball of said ball and socket joint;

a rearward portion of said mounting shaft extends from the rearward portion of said sleeve and perpendicular to the longitudinal axis of the bow;

a plurality of adjusting screws pass through a rearward portion of said sleeve allowing said mounting shaft to be located and to rigidly hold said mounting shaft at the proper tuned location;

a slide rod having a forward and rearward end;

a slide rod receiving hole of slightly larger diameter than said mounting shaft is located at said forward end of said slide rod;

said slide rod receiving hole being bored into a forward portion of said slide rod, parallel to the longitudinal axis of said slide rod, furthermore, said slide rod receiving hole is formed offset from center into a forward portion of said slide rod allowing a frictional between a rearward portion of said mounting shaft and the bore of said slide rod receiving hole enabling the longitudinal axis to said slide rod to orbit in a parallel fashion around the longitudinal axis of said mounting shaft;

means to rigidly hold said slide rod in its tuned orbital position onto said mounting shaft;

a slide having a forward and rearward end;

said slide slidably surrounds said slide rod;

said slide having a guide pin locator notch at said rearward end of said slide;

means attached to said slide to rigidly hold an archers trigger release mechanism onto said slide to allow the bow string and said slide to be drawn rearward from a middle portion of the bow and parallel to the longitudinal axis of said slide rod;

a guide pin located at a rearward portion of said slide rod to locate said guide pin notch to said guide pin, allowing said slide and a bow string to be drawn to its correct tuned position.

* * * * *